US010478713B1

(12) United States Patent
Earvin

(10) Patent No.: US 10,478,713 B1
(45) Date of Patent: Nov. 19, 2019

(54) JUMPING TOY

(71) Applicant: Johnathan Earvin, Portchester, NY (US)

(72) Inventor: Johnathan Earvin, Portchester, NY (US)

( * ) Notice: Subject to any disclaimer, the term of this patent is extended or adjusted under 35 U.S.C. 154(b) by 0 days.

(21) Appl. No.: 16/253,286

(22) Filed: Jan. 22, 2019

(51) Int. Cl.
*A63F 7/24* (2006.01)

(52) U.S. Cl.
CPC ..... *A63F 7/2472* (2013.01)

(58) Field of Classification Search
CPC ..... A63F 7/2472; A63H 3/36
USPC ..... 446/486
See application file for complete search history.

(56) References Cited

U.S. PATENT DOCUMENTS

| | | | | |
|---|---|---|---|---|
| 1,152,639 | A * | 9/1915 | Isaacs | A63H 11/06 446/311 |
| 2,627,700 | A * | 2/1953 | Weiss | A63H 11/06 446/312 |
| 2,824,409 | A | 2/1958 | Brodrib | |
| 3,603,030 | A | 9/1971 | Bart | |
| D226,773 | S | 4/1973 | Ehrenreicli | |
| 4,037,357 | A | 7/1977 | Monroe | |
| 5,213,538 | A | 5/1993 | Willett | |
| 5,462,285 | A * | 10/1995 | O'Patka | A63F 9/0079 124/16 |
| 5,941,755 | A * | 8/1999 | Danielian | A63H 11/06 446/312 |
| 6,899,589 | B1 * | 5/2005 | Lund | A63H 11/02 446/351 |
| 7,222,859 | B2 | 5/2007 | Mitvalsky | |
| 8,371,889 | B2 * | 2/2013 | Kure | H01T 21/06 313/141 |
| 2001/0054518 | A1 * | 12/2001 | Buehler | B62D 63/02 180/8.1 |
| 2017/0340978 | A1 * | 11/2017 | Capusotto | A63H 3/003 |

FOREIGN PATENT DOCUMENTS

| | | |
|---|---|---|
| WO | 9939794 | 8/1999 |

* cited by examiner

*Primary Examiner* — Michael D Dennis
(74) *Attorney, Agent, or Firm* — Kyle A. Fletcher, Esq.

(57) ABSTRACT

The jumping toy comprises a puppet, a plurality of springs, and a counter. The counter and the plurality of springs attach to the puppet. The jumping toy is configured for use with a supporting surface. The jumping toy is pressed against the supporting surface such that the plurality of springs is deformed. When the jumping toy is released, each of the plurality of springs returns to its relaxed position such that the jumping toy "jumps" to an elevation above the supporting surface. The counter is a mechanical device. The counter counts the number of times the jumping toy jumps. The puppet is a composite prism structure that visually presents a dynamic expression during the use of the jumping toy.

20 Claims, 5 Drawing Sheets

JUMPING TOY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports, games, and amusements including toys, more specifically, a popper toy that jumps when returning after deformation into its relaxed shape. (A63H37/005).

SUMMARY OF INVENTION

The jumping toy comprises a puppet, a plurality of springs, and a counter. The counter and the plurality of springs attach to the puppet. The jumping toy is configured for use with a supporting surface. The jumping toy is pressed against the supporting surface such that the plurality of springs are deformed. When the jumping toy is released, each of the plurality of springs returns to its relaxed position such that the jumping toy "jumps" to an elevation above the supporting surface. The counter is a mechanical device. The counter counts the number of times the jumping toy jumps. The puppet is a composite prism structure that visually presents a dynamic expression during the use of the jumping toy.

These together with additional objects, features and advantages of the jumping toy will be readily apparent to those of ordinary skill in the art upon reading the following detailed description of the presently preferred, but nonetheless illustrative, embodiments when taken in conjunction with the accompanying drawings.

In this respect, before explaining the current embodiments of the jumping toy in detail, it is to be understood that the jumping toy is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the jumping toy.

It is therefore important that the claims be regarded as including such equivalent construction insofar as they do not depart from the spirit and scope of the jumping toy. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
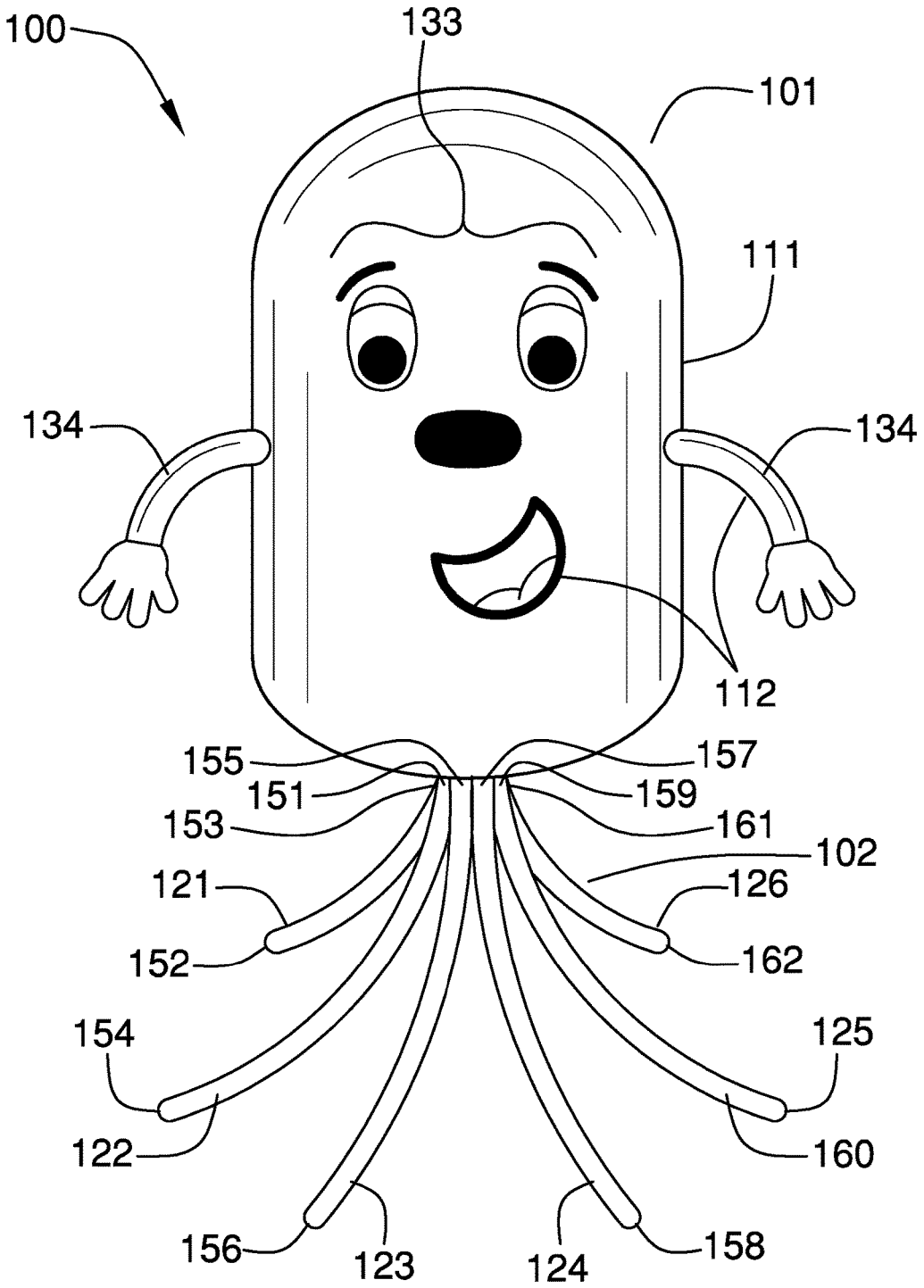
FIG. 1 is a perspective view of an embodiment of the disclosure.
Figure 2:
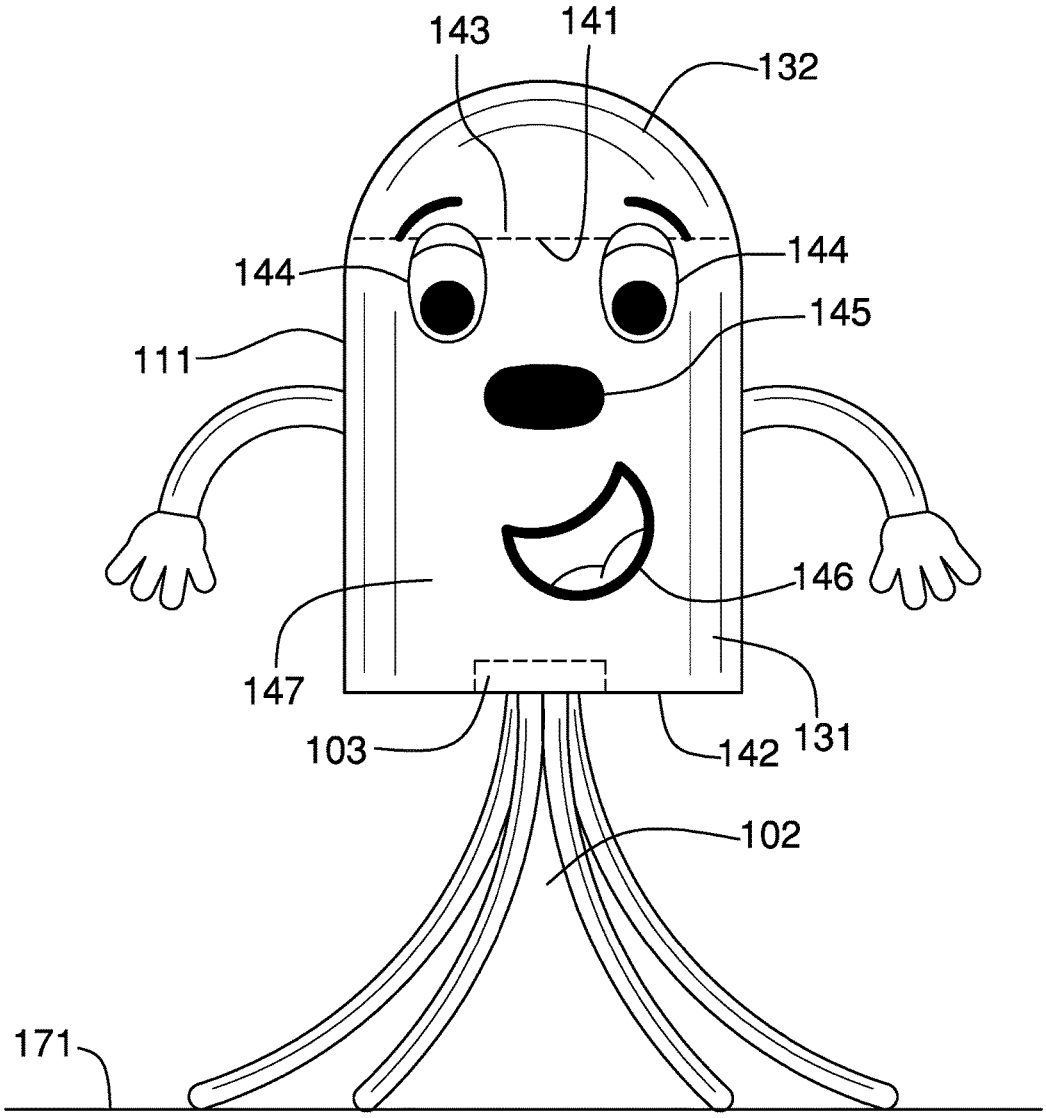
FIG. 2 is a front view of an embodiment of the disclosure.
Figure 3:
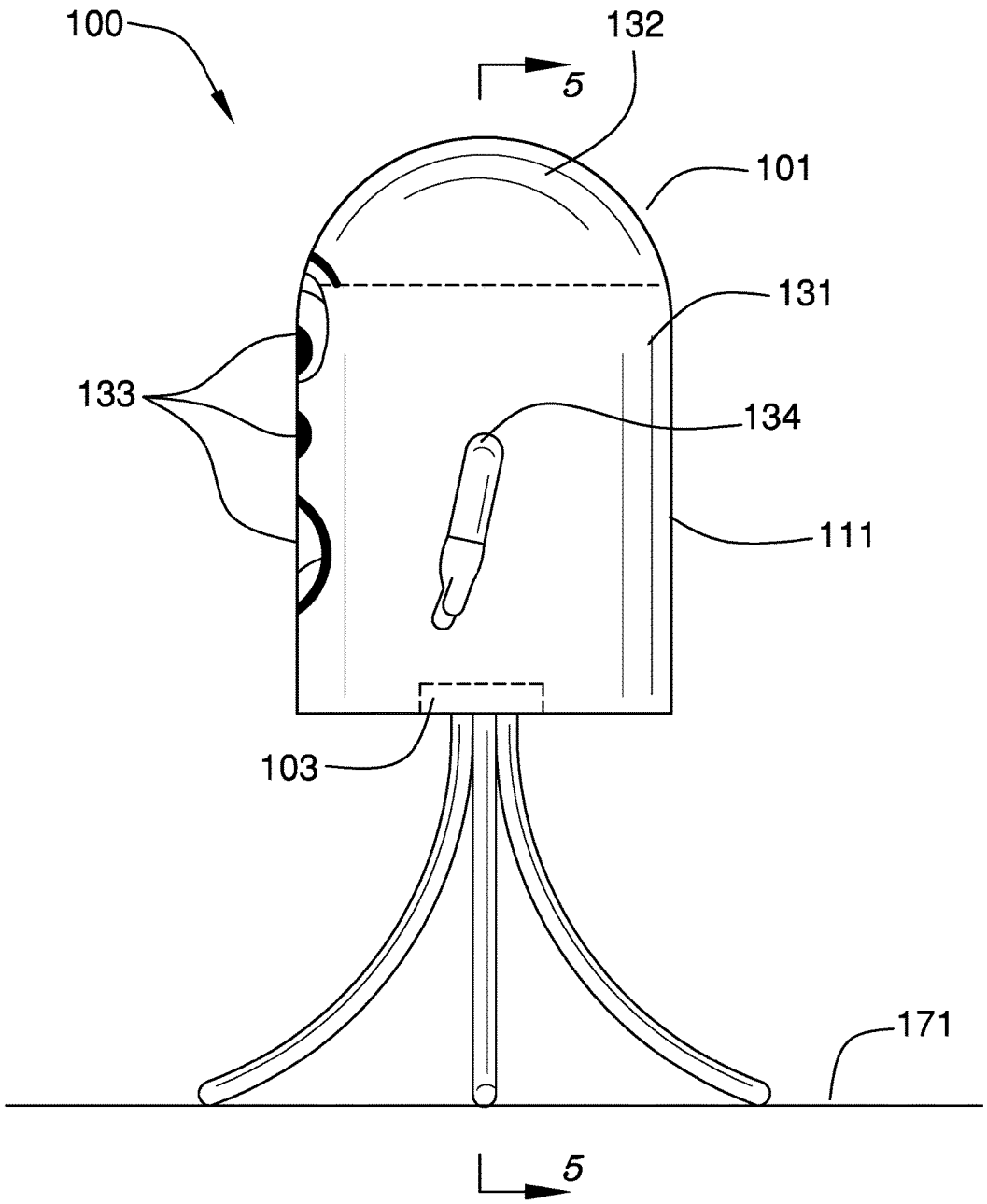
FIG. 3 is a side view of an embodiment of the disclosure.
Figure 4:
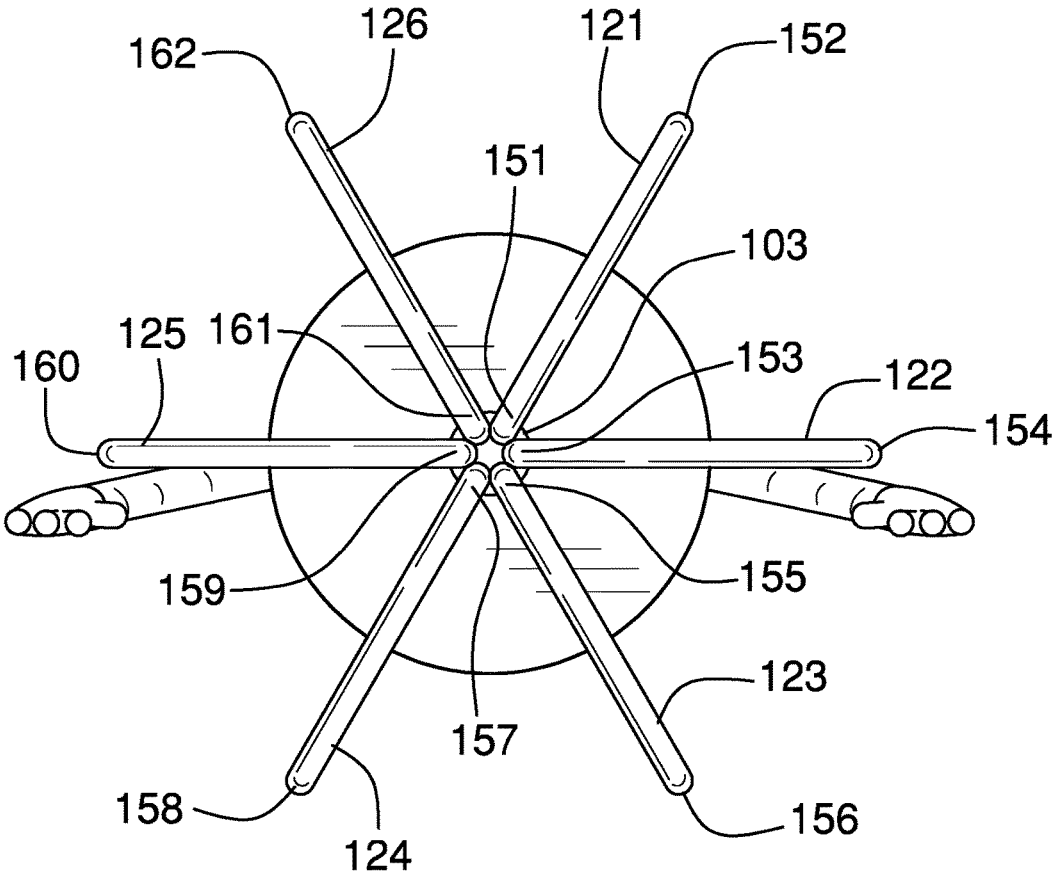
FIG. 4 is a bottom view of an embodiment of the disclosure.
Figure 5:
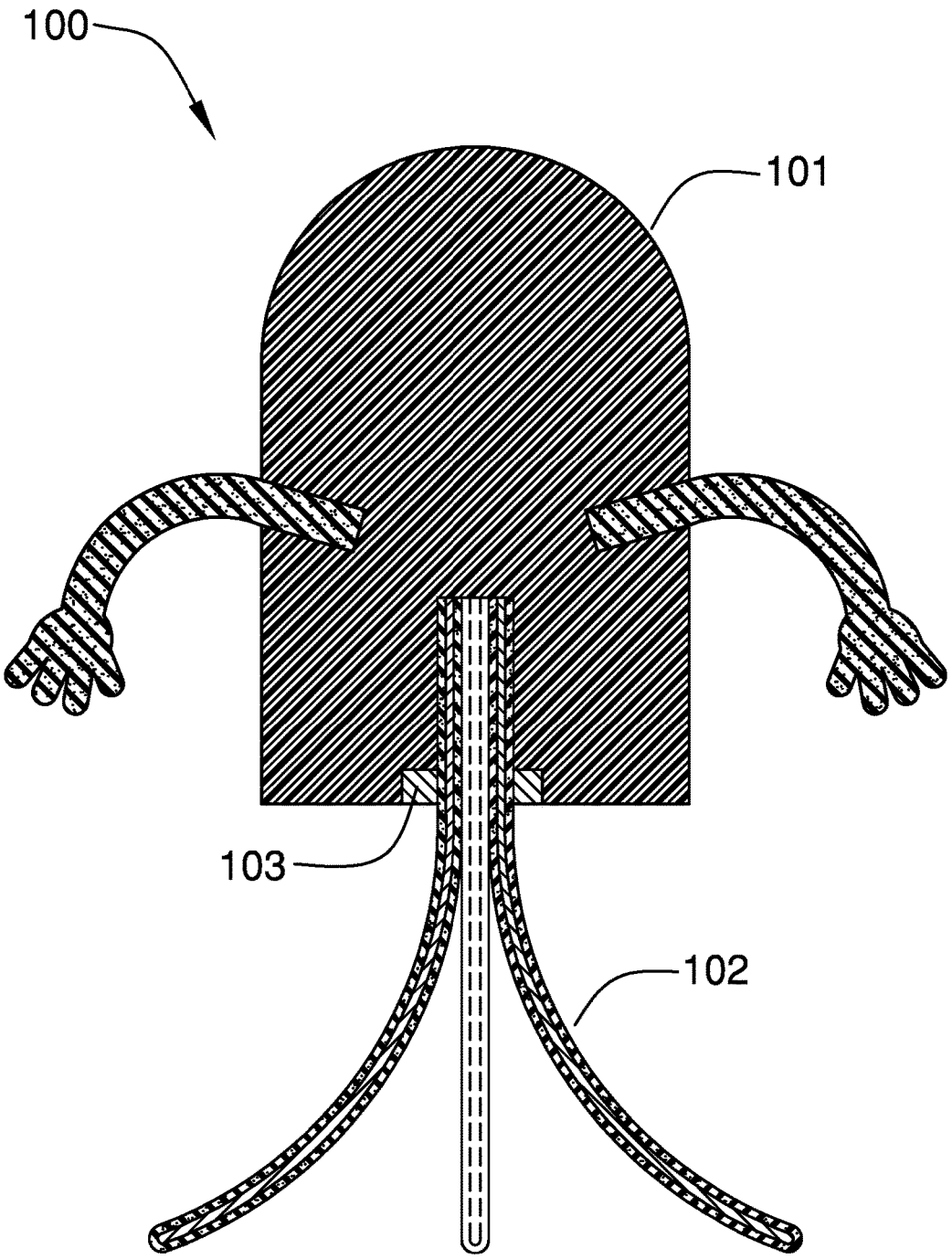
FIG. 5 is a cross-sectional view of an embodiment of the disclosure across 5-5 as shown in FIG. 3.

Detailed reference will now be made to one or more potential embodiments of the disclosure, which are illustrated in FIGS. 1 through 5.

The jumping toy 100 (hereinafter invention) comprises a puppet 101, a plurality of springs 102, and a counter 103. The counter 103 and the plurality of springs 102 attach to the puppet 101. The invention 100 is configured for use with a supporting surface 171. The invention 100 is pressed against the supporting surface 171 such that the plurality of springs 102 are deformed. When the invention 100 is released, each of the plurality of springs 102 returns to its relaxed position such that the invention 100 "jumps" to an elevation above the supporting surface 171. The counter 103 is a mechanical device. The counter 103 counts the number of times the invention 100 jumps. The puppet 101 is a composite prism structure that visually presents a dynamic expression during the use of the invention 100.

The counter 103 is a mechanical device. The counter 103 is a commercially available device. The counter 103 attaches to the puppet 101. The counter 103 attaches to a spring selected from the plurality of springs 102 such that the elevation of the invention 100 by the selected spring advances the counter 103.

The puppet 101 is a mechanical structure. The puppet 101 is configured to present an image. The image presented by the puppet 101 comprises indicia which represent the sentiment of an expression. The puppet 101 has the shape of a composite prism. The puppet 101 comprises an ovoid structure 111 and a decorative structure 112.

The ovoid structure 111 is a composite prism structure. The ovoid structure 111 forms the primary display structure of the puppet 101. The ovoid structure 111 is a rigid structure. The ovoid structure 111 provides the surface on which the decorative structure 112 is displayed. The ovoid structure 111 comprises a cylindrical structure 131 and a hemispherical structure 132.

The cylindrical structure 131 and the hemispherical structure 132 join to form the composite prism structure of the ovoid structure 111. The cylindrical structure 131 is a prism-shaped structure. The cylindrical structure 131 has a cylinder based prism structure. In the first potential embodiment of the disclosure, the cylindrical structure 131 is formed from plastic. The cylindrical structure 131 comprises a first base 141, a second base 142, and a lateral face 147. The first base is a base of the prism structure that forms the cylindrical structure 131. The second base 142 is a base of the prism structure that forms the cylindrical structure 131. The lateral face 147 is the surface of the cylindrical structure 131 that connects the first base 141 to the second base 142.

The hemispherical structure 132 is the truncation of a half a sphere through the center of the sphere. The truncated face 143 of the hemispherical structure 132 is geometrically identical to the first base 141 of the cylindrical structure 131. The hemispherical structure 132 attaches to the first base of the cylindrical structure 131 such that the center axis of the cylindrical structure 131 passes through the center of the sphere that formed the hemispherical structure 132 to form the composite prism structure of the ovoid structure 111. The hemispherical structure 132 comprises a truncated face 143. The truncated face 143 is a planar structure formed on the hemispherical structure 132. The truncated face 143 is formed by the plane that truncated the spherical structure of the hemispherical structure 132. In the first potential embodiment of the disclosure, the hemispherical structure 132 is formed from plastic.

The decorative structure 112 comprises a collection of decorative elements. The decorative structure 112 is configured to present a sentiment representing an expression. The decorative structure 112 attaches to the ovoid structure 111. Specifically, the decorative structure 112 attaches to the lateral face 147 of the cylindrical structure 131 of the puppet 101. The decorative structure 112 comprises a plurality of facial features 133 and a plurality of arms 134.

The plurality of facial features 133 are a collection of decorative items that attach to the lateral face 147 of the cylindrical structure 131. The plurality of facial features 133 create an image that displays the sentiment of an expression of a face. The plurality of facial features 133 creates a dynamic sentiment that changes with the motion of the invention 100. The plurality of facial features 133 comprises a plurality of eyes 144, a nose 145, and a mouth 146.

The plurality of eyes 144 are decorative findings used to form the eyes of the face formed by the plurality of facial features 133. In the first potential embodiment of the disclosure, each of the plurality of eyes 144 are formed from commercially available structures commonly marketed as wiggle eyes. Each of the plurality of eyes 144 are designed to move with the motion of the puppet 101 such that the plurality of eyes 144 give the overall decorative structure 112 a dynamic element.

The nose 145 is an image applied to the lateral face 147 of the cylindrical structure 131. The nose 145 displays an image that conveys the sentiment of a nose. The mouth 146 is an image applied to the lateral face 147 of the cylindrical structure 131. The mouth 146 displays an image that conveys the sentiment of a mouth 146.

The plurality of arms 134 are a collection of decorative items that attach to the lateral face 147 of the cylindrical structure 131. The plurality of arms 134 create an image that displays the sentiment of arms that extend away from a body.

Each of the plurality of springs 102 is a flat spring. Each of the plurality of springs 102 attaches to the exterior of the puppet 101 in the manner of a cantilever. The each of the plurality of springs 102 is a plate-shaped flat spring. Each of the plurality of springs 102 is as a spring. Specifically, when a force is applied perpendicular to the center axis of any spring selected from the plurality of springs 102, the elasticity of the selected spring creates a rotational torque that opposes the initial displacement created by rotating the selected spring. This rotational torque places a strain on the selected spring such that the force of the strain is in the direction that returns the selected spring to its original position. The energy returned by each of the plurality of springs 102 is such that the invention 100 elevates above the supporting surface 171 when each plurality of springs 102 simultaneously return to their relaxed shape.

The plurality of springs 102 comprises a first flat spring 121, a second flat spring 122, a third flat spring 123, a fourth flat spring 124, a fifth flat spring 125, and a sixth flat spring 126. The first flat spring 121 is further defined with a first end 151 and a second end 152. The second flat spring 122 is further defined with a third end 153 and a fourth end 154. The third flat spring 123 is further defined with a fifth end 155 and a sixth end 156. The fourth flat spring 124 is further defined with a seventh end 157 and an eighth end 158. The fifth flat spring 125 is further defined with a ninth end 159 and a tenth end 160. The sixth flat spring 126 is further defined with an eleventh end 161 and a twelfth end 162.

The first flat spring 121 is a semi-rigid structure with an elastic nature. The first flat spring 121 is a plate-shaped spring structure. The first flat spring 121 is formed from a material selected from the group consisting of spring steel or plastic. The first flat spring 121 acts as a torsion spring that deforms as the invention 100 presses against the supporting surface 171. As the invention 100 is released, the first flat spring 121 returns to it relaxed shape thereby providing a portion of the energy required to elevate the invention 100 above the supporting surface 171. The first flat spring 121 attaches to the second base 142 of the cylindrical structure 131 in the manner of a cantilever.

The second flat spring 122 is a semi-rigid structure with an elastic nature. The second flat spring 122 is a plate-shaped spring structure. The second flat spring 122 is formed from a material selected from the group consisting of spring steel or plastic. The second flat spring 122 acts as a torsion spring that deforms as the invention 100 presses against the supporting surface 171. As the invention 100 is released, the second flat spring 122 returns to it relaxed shape thereby providing a portion of the energy required to elevate the invention 100 above the supporting surface 171. The second flat spring 122 attaches to the second base 142 of the cylindrical structure 131 in the manner of a cantilever.

The third flat spring 123 is a semi-rigid structure with an elastic nature. The third flat spring 123 is a plate-shaped spring structure. The third flat spring 123 is formed from a material selected from the group consisting of spring steel or plastic. The third flat spring 123 acts as a torsion spring that deforms as the invention 100 presses against the supporting surface 171. As the invention 100 is released, the third flat spring 123 returns to it relaxed shape thereby providing a portion of the energy required to elevate the invention 100 above the supporting surface 171. The third flat spring 123 attaches to the second base 142 of the cylindrical structure 131 in the manner of a cantilever.

The fourth flat spring 124 is a semi-rigid structure with an elastic nature. The fourth flat spring 124 is a plate-shaped spring structure. The fourth flat spring 124 is formed from a material selected from the group consisting of spring steel or plastic. The fourth flat spring 124 acts as a torsion spring that deforms as the invention 100 presses against the supporting surface 171. As the invention 100 is released, the fourth flat spring 124 returns to it relaxed shape thereby providing a portion of the energy required to elevate the invention 100 above the supporting surface 171. The fourth flat spring 124 attaches to the second base 142 of the cylindrical structure 131 in the manner of a cantilever.

The fifth flat spring 125 is a semi-rigid structure with an elastic nature. The fifth flat spring 125 is a plate-shaped spring structure. The fifth flat spring 125 is formed from a material selected from the group consisting of spring steel or plastic. The fifth flat spring 125 acts as a torsion spring that deforms as the invention 100 presses against the supporting surface 171. As the invention 100 is released, the fifth flat spring 125 returns to it relaxed shape thereby providing a portion of the energy required to elevate the invention 100 above the supporting surface 171. The fifth flat spring 125 attaches to the second base 142 of the cylindrical structure 131 in the manner of a cantilever.

The sixth flat spring 126 is a semi-rigid structure. The sixth flat spring 126 is a plate-shaped spring structure. The sixth flat spring 126 is formed from a material selected from the group consisting of spring steel or plastic. The sixth flat spring 126 acts as a torsion spring that deforms as the invention 100 presses against the supporting surface 171. As the invention 100 is released, the sixth flat spring 126 returns to it relaxed shape thereby providing a portion of the energy required to elevate the invention 100 above the supporting surface 171. The sixth flat spring 126 attaches to the second base 142 of the cylindrical structure 131 in the manner of a cantilever.

By definition, the fourth flat spring 124 is the spring linked to the counter 103 for initiating the counting mechanism of the counter 103.

The following seven paragraphs describe the assembly of the invention 100.

The first end 151 of the first flat spring 121 attaches to the second base 142 of the cylindrical structure 131 such that the first end 151 forms the fixed end of the cantilever structure of the cylindrical structure 131.

The third end 153 of the second flat spring 122 attaches to the second base 142 of the cylindrical structure 131 such that the third end 153 forms the fixed end of the cantilever structure of the cylindrical structure 131.

The fifth end 155 of the third flat spring 123 attaches to the second base 142 of the cylindrical structure 131 such that the fifth end 155 forms the fixed end of the cantilever structure of the cylindrical structure 131.

The seventh end 157 of the fourth flat spring 124 attaches to the second base 142 of the cylindrical structure 131 such that the seventh end 157 forms the fixed end of the cantilever structure of the cylindrical structure 131.

The ninth end 159 of the fifth flat spring 125 attaches to the second base 142 of the cylindrical structure 131 such that the ninth end 159 forms the fixed end of the cantilever structure of the cylindrical structure 131.

The eleventh end 161 of the sixth flat spring 126 attaches to the second base 142 of the cylindrical structure 131 such that the eleventh end 161 forms the fixed end of the cantilever structure of the cylindrical structure 131.

The counter 103 attaches to the interior surface of the second base 142 of the cylindrical structure 131. The counter 103 mechanically links with a spring selected from the plurality of springs 102 such that the deformation of the selected spring activates the counter 103 during the oscillation of the plurality of springs 102.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure formed from a plurality of structures selected from the group consisting of a prism structure, a pyramid structure, and a spherical structure. The plurality of selected structures may or may not be truncated. The plurality of prism structures are joined together such that the center axes (or spherical diameter) of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Always use Geometrically similar, correspond and one to one Copolymer: As used in this disclosure, a copolymer is a polymer formed from two or more repeating molecules (also referred to as monomers).

Correspond: As used in this disclosure, the term correspond is used as a comparison between two or more objects wherein one or more properties shared by the two or more objects match, agree, or align within acceptable manufacturing tolerances.

Counter: As used in this disclosure, a counter refers to a device that maintains the count of a number of objects or actions. A counter will increase the count in multiples of fixed increments. A countdown counter refers to a counter that decreases count in multiples of fixed increments.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. Specifically, the surface area of an end of the prism-shaped object that forms the disk is greater than the lateral face of the prism-shaped object that forms the disk. In this disclosure, the ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Expression: As used in this disclosure, an expression is a term that refers to the visual appearance of a human face. It is believed that certain expressions displayed on the human face correlate to an emotional state. This correlation is exploited, often through caricature, in artistic representations of the human figure.

Flat Spring: As used in this disclosure, a flat spring is a device designed to store and release mechanical energy that is made of a flat or conical piece of material.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hemisphere: As used in this disclosure, a hemisphere is a structure formed in the shape of a half a sphere. Such a structure would be described as hemispherical.

Image: As used in this disclosure, an image is an optical representation or reproduction of an indicia or of the appearance of something or someone.

Indicia: As used in this disclosure, the term indicia refers to a set of markings that identify a sentiment.

Monomer: As used in this disclosure, a monomer refers to a molecular structure that bonds to itself in a repeating manner to form a polymer.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Oval: As used in this disclosure, an oval is a geometric shape that is formed in the shape of a "squished" circle similar in form to an ellipse. The difference between an oval and an ellipse is that an ellipse can be described by a mathematical formula while an oval has no such description. The term ovoid refers to a three-dimensional structure with an oval shape that is analogous to the relationship of an ellipsoid and an ellipse.

Organic: As used in this disclosure, organic refers to a carbon-based chemical structure. A limited number of carbon-based salts are traditionally considered inorganic chemical structures and are excluded from the study of organic chemistry.

Plastic: As used in this disclosure, plastic refers to a manufactured material that is formed from a structure selected from the group consisting of a polymer or a copolymer. Unless stated otherwise, this disclosure assumes that the plastic is formed from organic monomers.

Polymer: As used in this disclosure, a polymer refers to a molecular chain that comprises multiple repeating units known as monomers. The repeating unit may be an atom or a molecular structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder. See Truss.

Puppet: As used in this disclosure, a puppet is a FIG. resembling a human, animal or symbolic image that can be moved and that is used for entertainment or educational purposes. Puppets are often used as tokens within a board game.

Radial: As used in this disclosure, the term radial refers to a direction that: 1) is perpendicular to an identified central axis; or, 2) projects away from a center point.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Semi-Rigid Structure: As used in this disclosure, a semi-rigid structure is a solid structure that is stiff but not wholly inflexible, and that will deform under force before breaking. A semi-rigid structure may or may not behave with an elastic nature in that a semi-rigid structure need not return to its relaxed shape.

Sentiment: As used in this disclosure, a sentiment refers to a symbolic meaning or message that is communicated through the use of an image, potentially including a text-based image.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Torque: As used in this disclosure, a torque refers to a force that causes an object to rotate.

Torsion: As used in this disclosure, torsion refers to the application of a torque to an object.

Torsion Spring: As used in this disclosure, a torsion spring is a mechanical device that stores mechanical energy through an opposing torque when the mechanical device is bent or twisted. The torsion spring will return to its original relaxed shape when the twisting force is removed.

Truncated: As used in this disclosure, a geometric object is truncated when an apex, vertex, or end is cut off by a line or plane.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A jumping toy comprising
a puppet, a plurality of springs, and a counter;
wherein the counter and the plurality of springs attach to the puppet;
wherein the jumping toy is configured for use with a supporting surface;
wherein the jumping toy presses against the supporting surface such that the plurality of springs are deformed;
wherein each of the plurality of springs returns to its relaxed position such that the jumping toy "jumps" to an elevation above the supporting surface;
wherein the counter is a mechanical device;
wherein the counter counts the number of times the jumping toy jumps;
wherein the counter attaches to a spring selected from the plurality of springs such that the elevation of the jumping toy by the selected spring advances the counter.

2. The jumping toy according to claim 1
wherein the puppet is a mechanical structure;
wherein the puppet is configured to present an image;
wherein the image presented by the puppet comprises indicia which represent the sentiment of an expression;
wherein the expression is dynamic.

3. The jumping toy according to claim 2 wherein the counter is a mechanical device.

4. The jumping toy according to claim 3
wherein each of the plurality of springs is a flat spring;
wherein each of the plurality of springs attaches to the exterior of the puppet in the manner of a cantilever;
wherein specifically, when a force is applied perpendicular to the center axis of any spring selected from the plurality of springs, the elasticity of the selected spring creates a rotational torque that opposes the initial displacement created by rotating the selected spring;
wherein this rotational torque places a strain on the selected spring such that the force of the strain is in the direction that returns the selected spring to its original position;
wherein the plurality of springs elevates the jumping toy elevates above the supporting surface.

5. The jumping toy according to claim 4
wherein the puppet comprises an ovoid structure and a decorative structure;
wherein the ovoid structure is a composite prism structure;
wherein the decorative structure attaches to the ovoid structure.

6. The jumping toy according to claim 5
wherein the ovoid structure comprises a cylindrical structure and a hemispherical structure;
wherein the hemispherical structure attaches to the cylindrical structure;
wherein the cylindrical structure and the hemispherical structure form the composite prism structure of the ovoid structure.

7. The jumping toy according to claim 6
wherein the cylindrical structure is a prism-shaped structure;
wherein the cylindrical structure has a cylinder based prism structure;
wherein the cylindrical structure comprises a first base, a second base, and a lateral face;
wherein the first base is a base of the prism structure that forms the cylindrical structure;
wherein the second base is a base of the prism structure that forms the cylindrical structure;
wherein the lateral face is the surface of the cylindrical structure that connects the first base to the second base.

8. The jumping toy according to claim 7
wherein the hemispherical structure is the truncation of a half a sphere through the center of the sphere;
wherein the hemispherical structure attaches to the first base of the cylindrical structure such that the center axis of the cylindrical structure passes through the center of the sphere that formed the hemispherical structure to form the composite prism structure of the ovoid structure.

9. The jumping toy according to claim 8
wherein the hemispherical structure comprises a truncated face;

wherein the truncated face is a planar structure formed on the hemispherical structure;

wherein the truncated face is formed by the plane that truncated the spherical structure of the hemispherical structure;

wherein the truncated face of the hemispherical structure is geometrically identical to the first base of the cylindrical structure.

10. The jumping toy according to claim 9 wherein the decorative structure comprises a plurality of facial features and a plurality of arms;

wherein the plurality of facial features attach to the lateral face of the cylindrical structure;

wherein the plurality of arms attach to the lateral face of the cylindrical structure;

wherein the plurality of facial features create an image that displays the sentiment of an expression of a face;

wherein the plurality of facial features creates a dynamic sentiment.

11. The jumping toy according to claim 10 wherein the plurality of facial features comprises a plurality of eyes, a nose, and a mouth;

wherein the plurality of eyes are decorative findings;

wherein in, each of the plurality of eyes are formed from wiggle eyes;

wherein each of the plurality of eyes move with the motion of the puppet;

wherein the nose is an image;

wherein the mouth is an image.

12. The jumping toy according to claim 11 wherein the plurality of arms create a structure that forms an image that displays the sentiment of arms that extend away from a body.

13. The jumping toy according to claim 12 wherein the plurality of springs comprises a first flat spring, a second flat spring, a third flat spring, and a fourth flat spring, a fifth flat spring, and a sixth flat spring;

wherein the first flat spring is further defined with a first end and a second end;

wherein the second flat spring is further defined with a third end and a fourth end;

wherein the third flat spring is further defined with a fifth end and a sixth end;

wherein the fourth flat spring is further defined with a seventh end and an eighth end;

wherein the first flat spring attaches to the second base of the cylindrical structure in the manner of a cantilever;

wherein the second flat spring attaches to the second base of the cylindrical structure in the manner of a cantilever;

wherein the third flat spring attaches to the second base of the cylindrical structure in the manner of a cantilever;

wherein the fourth flat spring attaches to the second base of the cylindrical structure in the manner of a cantilever.

14. The jumping toy according to claim 13 wherein the first flat spring is a semi-rigid structure with an elastic nature;

wherein the second flat spring is a semi-rigid structure with an elastic nature;

wherein the third flat spring is a semi-rigid structure with an elastic nature;

wherein the fourth flat spring is a semi-rigid structure with an elastic nature.

15. The jumping toy according to claim 14 wherein the first flat spring is a plate-shaped spring structure;

wherein the second flat spring is a plate-shaped spring structure;

wherein the third flat spring is a plate-shaped spring structure;

wherein the fourth flat spring is a plate-shaped spring structure.

16. The jumping toy according to claim 15 wherein the first flat spring forms a torsion spring;

wherein the second flat spring forms a torsion spring;

wherein the third flat spring forms a torsion spring;

wherein the fourth flat spring forms a torsion spring.

17. The jumping toy according to claim 16 wherein the plurality of springs further comprises a fifth flat spring;

wherein the fifth flat spring is further defined with an eleventh end and a twelfth end;

wherein the fifth flat spring attaches to the second base of the cylindrical structure in the manner of a cantilever;

wherein the fifth flat spring is a semi-rigid structure with an elastic nature;

wherein the fifth flat spring is a plate-shaped spring structure;

wherein the fifth flat spring forms a torsion spring.

18. The jumping toy according to claim 17 wherein the plurality of springs further comprises a sixth flat spring;

wherein the sixth flat spring is further defined with an eleventh end and a twelfth end;

wherein the sixth flat spring attaches to the second base of the cylindrical structure in the manner of a cantilever;

wherein the sixth flat spring is a semi-rigid structure;

wherein the sixth flat spring is a plate-shaped spring structure;

wherein the sixth flat spring acts forms a torsion spring.

19. The jumping toy according to claim 18 wherein the ovoid structure is a rigid structure;

wherein the counter attaches to the interior surface of the second base of the cylindrical structure;

wherein the counter mechanically links with fourth spring such that the deformation of the selected spring activates the counter during the oscillation of the plurality of springs.

20. The jumping toy according to claim 19 wherein the first flat spring is formed from a material selected from the group consisting of spring steel or plastic;

wherein the second flat spring is formed from a material selected from the group consisting of spring steel or plastic;

wherein the third flat spring is formed from a material selected from the group consisting of spring steel or plastic;

wherein the fourth flat spring is formed from a material selected from the group consisting of spring steel or plastic;

wherein the fifth flat spring is formed from a material selected from the group consisting of spring steel or plastic;

wherein the sixth flat spring is formed from a material selected from the group consisting of spring steel or plastic;

wherein the cylindrical structure is formed from plastic;

wherein the hemispherical structure is formed from plastic.

* * * * *